US009205471B2

(12) United States Patent
Ross et al.

(10) Patent No.: US 9,205,471 B2
(45) Date of Patent: Dec. 8, 2015

(54) FLUSHING DEVICE

(75) Inventors: Martin Ross, Sjöbo (SE); Joacim Cronholm, Barsebäck (SE)

(73) Assignee: Scanjet Marine AB, Sjobo (SE)

( * ) Notice: Subject to any disclaimer, the term of this patent is extended or adjusted under 35 U.S.C. 154(b) by 977 days.

(21) Appl. No.: 13/256,456

(22) PCT Filed: Apr. 6, 2010

(86) PCT No.: PCT/SE2010/050376
§ 371 (c)(1),
(2), (4) Date: Sep. 14, 2011

(87) PCT Pub. No.: WO2010/117324
PCT Pub. Date: Oct. 14, 2010

(65) Prior Publication Data

US 2012/0017951 A1 Jan. 26, 2012

(30) Foreign Application Priority Data

Apr. 9, 2009 (SE) ..... 0900478-9

(51) Int. Cl.
*B08B 9/093* (2006.01)

(52) U.S. Cl.
CPC ..... *B08B 9/0936* (2013.01)

(58) Field of Classification Search
CPC ..... B08B 9/0936
USPC ..... 134/167 R, 168 R, 169 R
See application file for complete search history.

(56) References Cited

U.S. PATENT DOCUMENTS 2,800,366 A 7/1957 Scruggs
2,895,688 A * 7/1959 Seiberling et al. ..... 239/559

(Continued)

FOREIGN PATENT DOCUMENTS

DE 10 2004 052 794 10/2005
SE 530 570 8/2008

(Continued)

OTHER PUBLICATIONS

Instruction Manual Type Gunclean Toftejorg SSt40T, Jun. 9, 2012.

*Primary Examiner* — Michael Barr
*Assistant Examiner* — Benjamin L Osterhout
(74) *Attorney, Agent, or Firm* — Tarolii, Sundheim, Covell & Tummino LLP

(57) ABSTRACT

A flushing device (1) includes a flush liquid pipe (6) arranged in an enclosed space (2) with at least one flush head (7) which is substantially rotatable about the longitudinal axis (A) of the flush liquid pipe, and a nozzle device (8) arranged on said flush head, being substantially rotatable about an axis (B) extending substantially transversely to the longitudinal axis of said flush liquid pipe, having one or more nozzles (9, 11) for the provision of one or more flush liquid streams (10, 12) directed substantially against the inside of the enclosed space for the cleaning thereof. To provide a flushing device (1) which also permits cleaning of components of the flushing device (1) which are located within the enclosed space (2), at least one of the one or more nozzles (9, 11) of the nozzle device (8) are arranged and/or formed such that at least a portion of the flush liquid streams (10 and 12) from the nozzle during at least a portion of the rotation of the nozzle device contacts the flush liquid pipe (6) along a portion of the periphery of the flush liquid pipe and such that at least the portion of the flush liquid stream from the nozzle contacts the flush liquid pipe during rotation of the flush head (7) along the entirety of, or a portion of, its periphery, thereby cleaning the flush liquid pipe.

15 Claims, 3 Drawing Sheets

(56) References Cited

U.S. PATENT DOCUMENTS

| | | | | | |
|---|---|---|---|---|---|
| 2,917,243 | A | * | 12/1959 | Lione | 239/227 |
| 3,544,012 | A | * | 12/1970 | McNally | 239/227 |
| 4,244,524 | A | * | 1/1981 | Wellings | 239/227 |
| 5,333,630 | A | | 8/1994 | Jepsen et al. | |
| 6,213,134 | B1 | * | 4/2001 | Pike | 134/166 R |
| 6,568,413 | B1 | | 5/2003 | Hurskainen | |
| 7,686,893 | B2 | * | 3/2010 | Robinson | 134/168 R |
| 2003/0145880 | A1 | * | 8/2003 | Jepsen et al. | 134/167 R |
| 2004/0238009 | A1 | | 12/2004 | Falster-Hansen et al. | |
| 2008/0142042 | A1 | | 6/2008 | Bramsen | |
| 2010/0043849 | A1 | | 2/2010 | Ross | |

FOREIGN PATENT DOCUMENTS

| | | |
|---|---|---|
| WO | 92/04994 | 4/1992 |
| WO | 2006/048067 | 5/2006 |
| WO | 2007/090395 | 8/2007 |
| WO | 2008/058541 | 5/2008 |
| WO | 2008/060223 | 5/2008 |

* cited by examiner

FLUSHING DEVICE

RELATED APPLICATION

This application corresponds to PCT/SE2010/050376, filed Apr. 6, 2010, which claims benefit of Swedish Appln. No. 0900478-9, filed Apr. 9, 2009, the subject matter of which is incorporated herein by reference.

TECHNICAL FIELD

The present invention relates to a flushing device for cleaning the inside of an enclosed space by means of a flush liquid. The flushing device comprises a flush liquid pipe arranged in said enclosed space. The flush liquid pipe is provided with at least one driven flush head, which is substantially rotatable about the longitudinal axis of the flush liquid pipe, and at least one driven nozzle device arranged on said flush head, which is substantially rotatable about an axis extending substantially transversely to the longitudinal axis of said flush liquid pipe. In turn, the nozzle device has one or more nozzles for the provision of one or more flush liquid streams directed substantially against the inside of said enclosed space, for cleaning of said enclosed space.

BACKGROUND OF THE INVENTION

A flushing device of the present kind is to a large extent known, e.g. from SE 0602447-5. The flushing device is used to clean e.g. marine tanks or other containers when these are empty. The flushing device can be programmed e.g. to work for a predetermined time period and according to a predetermined cleaning pattern for optimal cleaning with the least consumption of flush liquid. The flushing device can be permanently mounted or be mounted only when required.

One disadvantage with these flushing devices is that they do not permit cleaning of—above all—the flush liquid pipe of the flushing device.

SUMMARY OF THE INVENTION

One aim, therefore, of the present invention is to provide a flushing device as above, which—in addition to its principal aim of cleaning enclosed spaces such as tanks or other types of containers—also permits cleaning of those parts of the flushing device which are located in said enclosed space, in particular the flush liquid pipe of the flushing device.

A further aim of the present invention is to provide a flushing device for the above-mentioned use, which does not need to be made more complicated than previously-known devices, but instead comprises substantially the same number of components in substantially the same arrangement. The flushing device therefore becomes cost-effective and simple to construct.

The above aims, and other aims, of the invention are substantially achieved in that the flushing device described in the introduction has been provided with the characterizing features of claim 1.

Preferred variants of the flushing device according to the invention are presented in the dependent claims.

BRIEF DESCRIPTION OF THE DRAWINGS

A preferred embodiment of the flushing device of the present invention will be more closely described below, with reference to the enclosed schematic drawings, which only show those details necessary for understanding of the invention.

DETAILED DESCRIPTION OF PREFERRED EMBODIMENTS

Figure 1:
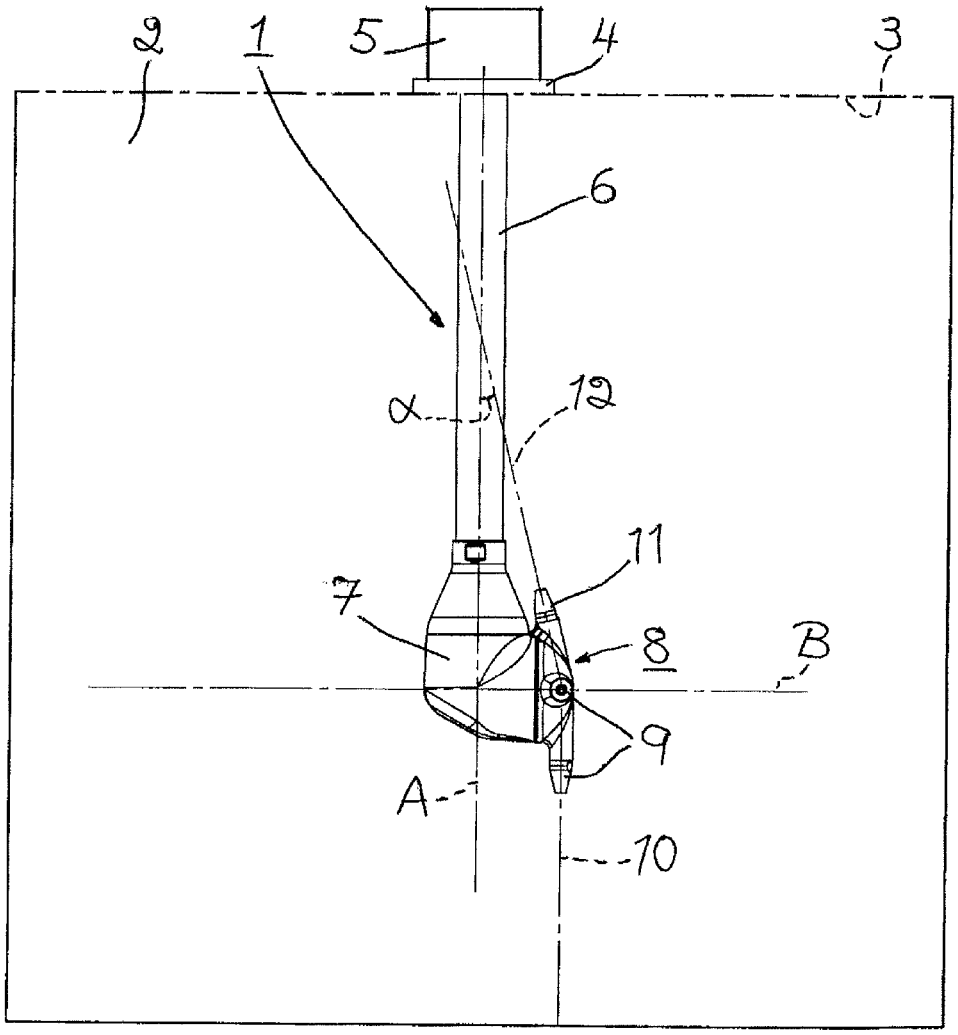
FIG. 1 provides a schematic side-view of a first embodiment of a flushing device according to the present invention.
Figure 2:
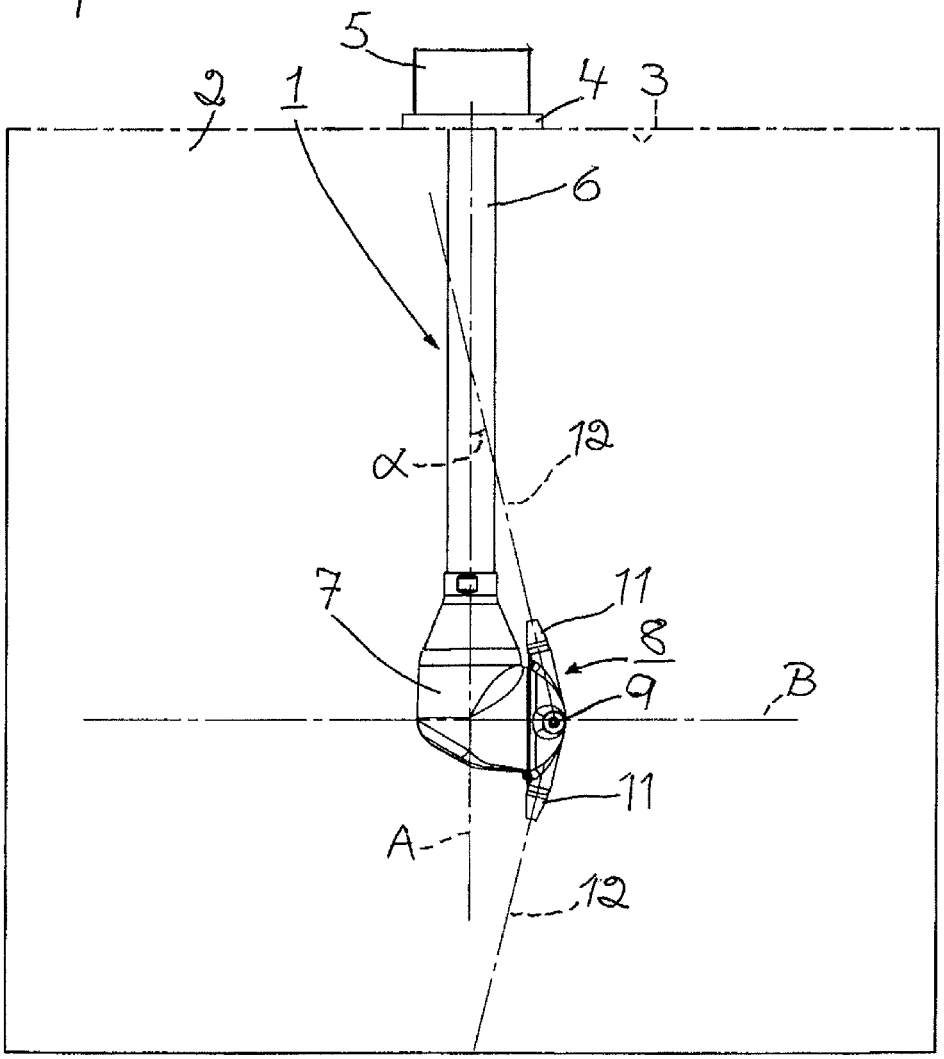
FIG. 2 shows a schematic side-view of a second embodiment of a flushing device according to the present invention.

FIG. 1 therefore provides a flushing device 1 for cleaning of the insides of an enclosed space and 2 by means of a flush liquid, and a schematic side-view thereof in FIG. 2. The enclosed space 2 can be a tank, e.g. a marine tank or other container, the upper surface 3 of which is illustrated with a dotted line. The flushing device 1 has a fastening plate 4 through which it is located on said upper surface 3. In the embodiment shown in FIG. 1, the flushing device 1 comprises an inlet housing 5, a flush liquid pipe 6, a flush head 7 and a nozzle device 8 with one or more nozzles 9. The inlet housing 5 is located above, and fastened to, the fastening plate 4. The flush liquid pipe 6 is immovably located in the inlet housing 5 and extends therefrom—suitably vertically—into the enclosed space 2 to be cleaned, i.e. whose insides are to be flushed with flush liquid. The flush head 7 is rotatably arranged on the flush liquid pipe 6 and is rotatably driven by a drive unit via the flush liquid and/or a suitable transmission and/or an external drive. In the illustrated embodiment, the flush head 7 is rotatably mounted on the lower end of the flush liquid pipe 6, but could, if so desired, in another embodiment, be mounted at another position along the flush liquid pipe. The flush head 7 rotates substantially about the longitudinal axis A of the flush liquid pipe, which—in the illustrated embodiments—runs substantially vertically, i.e. the flush head rotates in a substantially horizontal plane. The nozzle device 8 is in turn rotatably mounted on the flush head 7. The nozzle device 8 is thereby arranged such that it is rotatably driven by drive unit via the flush liquid and/or a suitable transmission and/or an external drive, so that it rotates substantially about an axis B which extends substantially transversely to the longitudinal axis of said flush liquid pipe 6, i.e. about a substantially horizontal axis in a substantially vertical plane. This occurs while the flush head 7 rotates about the longitudinal axis A of the flush liquid pipe 6. The nozzle device 8 comprises one or more nozzles 9 which emit one or more flush liquid streams 10 directed substantially towards the insides of the enclosed space 2. Reference is primarily made to FIG. 1, whereby the principal direction of the flush liquid stream 10 of the nozzle 9 is shown to be substantially parallel to the flush liquid pipe 6. The flushing device 1 is in any case formed in a known way to lead flush liquid to the flush liquid pipe 6 and through this and the flush head 7 to the nozzle device 8 and the nozzles 9 which direct the flush liquid streams 10 substantially towards the insides of the enclosed space 2 to clean them.

A flushing device of the above-described type is in principle known and is described in more detail in SE 0602447-5.

The flow of the flush liquid is pressurized, and the type of flush liquid can vary depending on the substance found in the enclosed space 2 to be cleaned.

The figures also present one or more nozzles 11 which—in the illustrated embodiments—differ from nozzle 9 in that they are oriented differently. Nozzles 9 and 11 can however all be of the same type.

According to the present invention, in order that the flushing device 1 can provide cleaning of—above all—the flush liquid pipe 1 of the flushing device, as well as cleaning of the enclosed space 2 in the form of e.g. marine tanks or other types of containers, at least one of said one or more nozzles 9,11 of the nozzle device 8 is arranged and/or formed such that at least a portion of the flush liquid streams 10 and 12 from the nozzle during at least a portion of the rotation of the nozzle device contacts the flush liquid pipe 6 along a portion of the periphery of the flush liquid pipe, and such that at least said portion of the flush liquid stream from the nozzle contacts the flush liquid pipe during rotation of the flush head 7 along the entirety of, or a portion of, its periphery, thereby cleaning the flush liquid pipe. This requires, in other words, that when nozzle device 8 rotates, at least a portion of the flush liquid stream 10 from at least one nozzle 9 (said flush liquid stream being primarily directed towards the insides of the enclosed space 2) and/or at least a portion of the flush liquid stream 12 from at least one nozzle 11 (which does not primarily need to be intended for cleaning of the insides of the space and which does not therefore necessarily provide flush liquid streams directed towards the insides of said space) will contact the flush liquid pipe 6 when the nozzle in question is located in such a portion of its rotational movement that this is possible. How much of the flush liquid streams is comprised by these "portions" is dependent on e.g. the spreading of the flush liquid stream in a plane substantially perpendicular to the flush pipe 6 seen in its longitudinal direction; in the illustrated embodiments with a substantially vertical flush liquid pipe in a plane substantially perpendicular to the vertical. The spreading of the flush liquid streams 10, 12 can therefore vary from nozzle to nozzle and can also suitably be individually regulated for each nozzle. For how long, and for how much of the rotation of the nozzle device 8, the flush liquid pipe 6 makes contact with a flush liquid stream 10, 12 depends on e.g. the spreading of the flush liquid stream in a plane perpendicular to the above-mentioned first plane for the spreading of the flush liquid stream, i.e. in the illustrated embodiments, in another vertical plane perpendicular to the above-mentioned first plane, as well as the rotational speed of the nozzle device 8. The flush liquid pipe 6 is contacted by the flush liquid streams 10, 12 substantially in the portion of its periphery in the middle of which the nozzle 9, 11 in question is momentarily located during rotation of the rinse head 7.

If the flushing device 1 in accordance with FIGS. 1 and 2 comprises at least one nozzle 11 and each nozzle—as e.g. in said figures—is arranged in relation to the flush liquid pipe 6 or, depending on where in the nozzle's rotational movement it is located, towards an imaginary extension of the flush liquid pipe, i.e. is angled towards and forms an acute angle therewith, this means that nozzle 11 can alternatively be arranged and/or formed such that not only a portion of, but rather the entire, flush liquid stream 12 from the nozzle during at least a portion of the rotation of the nozzle device 8 contacts the flush liquid pipe 6 along a portion of the periphery of the flush liquid pipe, and such that the entire flush liquid stream from the nozzle contacts the flush liquid pipe during the rotation of the flush head, along the entirety of or a portion of its periphery. Thereby, faster and more effective cleaning of the flush liquid pipe 6 is obtained, as the entire power of the flush liquid stream is applied to the flush liquid pipe. The principal direction of the flush liquid streams 12 from such an additional nozzle 11 is shown in FIGS. 1 and 2.

According to the invention, at least one of said one or more nozzles 9, 11 is arranged and/or formed such that the orientation thereof relative to the flush liquid pipe 6 is adjustable. In the embodiment with a plurality of nozzles 9,11, these are preferably individually adjustable. According to the invention, at least one of said one or more nozzles 9,11 formed so that the spreading of the flush liquid streams 10,12 from the nozzles is adjustable. In the embodiment with a plurality of nozzles 9,11, the flush liquid streams 10, 12 from these are preferably individually adjustable.

Figure 3:
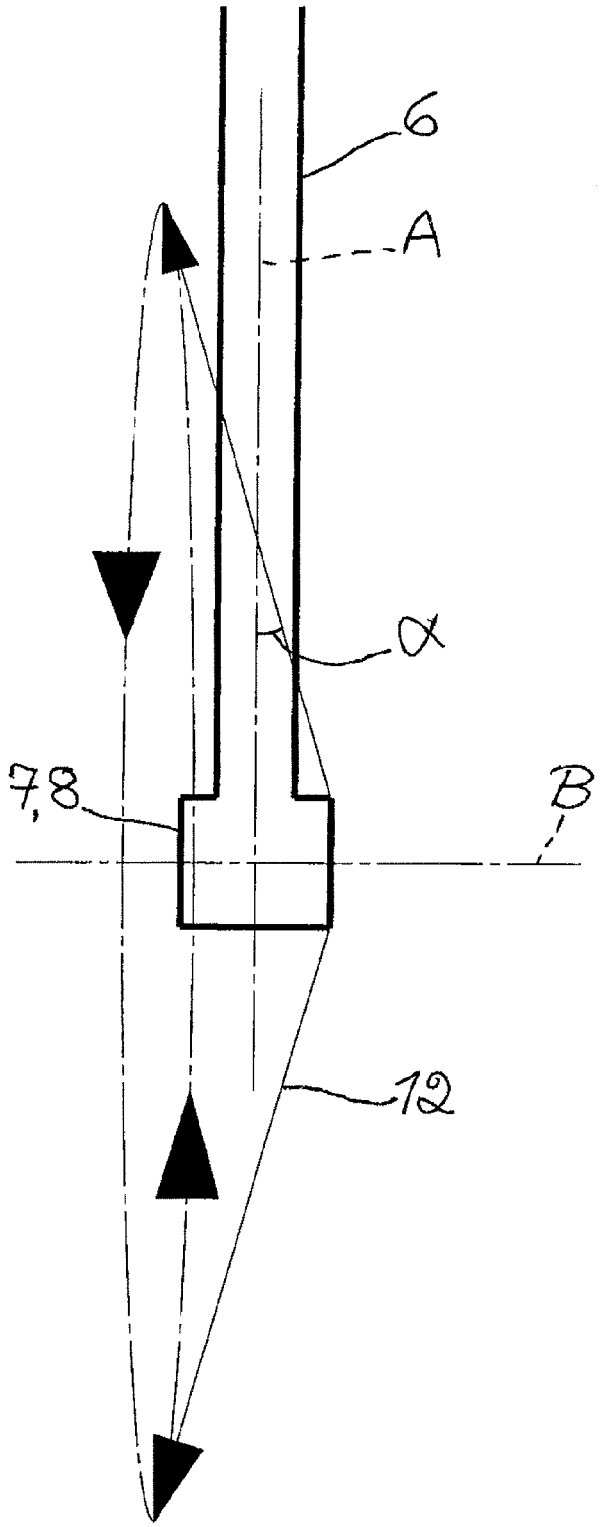
FIG. 3 provides a schematic side-view of the spray pattern of a flush liquid stream from a nozzle of the nozzle device of the flushing device according to the present invention, during the rotation of the nozzle device.

The flush liquid streams 12 generated by the nozzle 11 can take any form suitable for their purpose. In this way, the nozzle 11 can e.g. be arranged and/or formed so as to generate a flush liquid stream 12 which—during the rotation of the nozzle device 8—can substantially form or delimit a cone which opens in the direction of the flush liquid pipe 6 or the flush liquid pipe and an imaginary extension thereof, along a portion of the periphery of the flush liquid pipe, and which—during rotation of the flush head 7—opens in the direction of the flush liquid pipe or the flush liquid pipe and an imaginary extension thereof, along the entirety or a portion of the periphery of the flush liquid pipe (see FIG. 3). The cleaning of large portions of the flush liquid pipe is thereby obtained, which also contributes to faster cleaning.

According to one suitable embodiment of the flushing device 1, nozzle 11 is aligned towards the flush liquid pipe 6, at an angle $\alpha$ of 1°-30°, preferably circa 15° relative to the longitudinal axis A of the flush liquid pipe. The nozzle 11, and preferably the nozzle 9 can be arranged and/or formed such that said angle $\alpha$ is variable within the above interval, either continuously during operation of the flushing device, or intermittently with e.g. fixed setting which are adjusted between periods of operation, or stepwise during a period of operation. Rapid and effective cleaning of the flush liquid pipe 6 is hereby obtained. The nozzle 11, and the nozzles 9, as mentioned above, can furthermore be formed such as to provide—for optimal cleaning—a flush liquid stream 12 and 10 which also has a suitable spread in a direction other than the spreading based on the rotation of the nozzle device 8 towards the flush liquid pipe 6 seen in its longitudinal direction.

The nozzle device 8 can take any suitable form, and the nozzle or nozzles 9, 11, can be also be arranged in any suitable form. A plurality of nozzles 9,11 can e.g. be arranged in a row after one another along the rotational axis B for a nozzle device 8 which—in its simplest form—only comprises a pipe for flush liquid. In the case of a plurality of nozzles, these can suitably be pointed in different directions. Alternatively, two or more nozzles 9,11 can be located on a suitably-shaped branched pipe.

In the illustrated embodiments of the flushing device 1, however, the nozzle device 8 has the form of a hub, and the nozzles 9,11 are arranged peripherally on the hub. In the illustrated embodiments of the flushing device 1, the hub 8 is furthermore formed with four nozzles 9,11 arranged peripherally thereon. One (FIG. 1) or two (FIG. 2) of these nozzles (indicated on the figures as nozzle/nozzles 11) is formed and/or arranged such that at least a portion of the flush liquid stream(s) 12 from the nozzle(s) during at least a portion of the rotation of the hub 8 contacts the flush liquid pipe 6 along a portion of the periphery of the flush liquid pipe and such that at least said portion of the flush liquid stream(s) from the nozzle(s) contacts the flush liquid pipe during rotation of the flush head 7 along the entirety of, or a portion of, its periphery, thereby cleaning the flush liquid pipe. If two such nozzles 11 are present, they are arranged diametrically opposite each other. According to one embodiment of the invention (not shown), the nozzles 9, 11 can also be arranged and/or formed e.g. so that the flush liquid streams 12 from one nozzle 11 only partly contact the flush liquid pipe 6, while the flush liquid stream 12 from the other nozzle 11 completely contacts the flush liquid pipe. The flush liquid streams 10 from the other two nozzles 9 are directed primarily towards the insides of the enclosed space 2. In that it is possible to adjust the orientation of the nozzles 9,11 in relation to the flush liquid pipe 6, many other settings are conceivable. Adjustment can be made individually for each nozzle 9,11.

As a complement to the above-described nozzle 9,11, the flushing device 1 can, within the scope of the present invention, also comprise at least one nozzle (not shown) which is arranged and/or formed to generate a flush liquid stream which—during the rotation of the nozzle device 8—substantially forms or delimits a cone which opens in the direction of the flush liquid pipe 6. This is regardless of the rotational position of the flush head 7.

It is clear to the skilled person that the flushing device according to the present invention can be modified and changed within the scope of the following patent claims without departing from the idea and spirit of the invention. In this way, in addition to what is described above, the various parts of the flushing device which are located in the enclosed space can be arranged and/or formed in ways other than those described above and illustrated in the figures, while remaining within the scope of the claims. One or more flush liquid pipes can be arranged in one enclosed space and extend within said enclosed space in different ways. The flush liquid pipe 6 can—according to the invention—a varying length and can be supplied with a varying number of flush heads 7 and nozzle devices 8 of various designs, and the nozzle devices can comprise a varying number of nozzles of various types and in different locations to generate flush liquid streams with different spread and orientation. The various types of nozzles on one nozzle device can also differ from each other, as well as differing from those on other nozzle devices.

The invention claimed is:

1. A flushing device for cleaning the inside of an enclosed space by means of a flush liquid, said flushing device (1) comprising a flush liquid pipe (6) arranged in said enclosed space (2) with at least one flush head (7) which is substantially rotatable about the longitudinal axis (A) of the flush liquid pipe, and a nozzle device (8) arranged on said flush head, being substantially rotatable about an axis (B) extending substantially transversely to the longitudinal axis of said flush liquid pipe, having one or more nozzles (9, 11) for the provision of one or more flush liquid streams (10, 12) directed substantially against the inside of said enclosed space, wherein at least one of said one or more nozzles (9, 11) of the nozzle device (8) is arranged angled towards the flush liquid pipe (6) and/or formed for spreading of the flush liquid stream (10, 12) from the nozzle such that at least a portion of the flush liquid streams (10 and 12) from the nozzle during at least a portion of the rotation of the nozzle device contacts the flush liquid pipe (6) along a portion of the periphery of the flush liquid pipe and such that at least said portion of the flush liquid stream from the nozzle contacts the flush liquid pipe during rotation of the flush head (7) along the entirety of, or a portion of, its periphery, thereby cleaning the flush liquid pipe.

2. A flushing device according to claim 1, wherein said at least one nozzle (11) on said nozzle device (8) is arranged angled towards the flush liquid pipe (6) and/or formed for spreading of the flush liquid stream (12) from the nozzle such that the entire flush liquid stream (12) from the nozzle contacts the flush liquid pipe (6) during at least a portion of the rotation of the nozzle device (8) along a portion of the periphery of the flush liquid pipe, and such that the entire flush liquid stream from the nozzle contacts the flush liquid pipe during the rotation of the flush head (7), along the entirety of or a portion of its periphery, thereby cleaning the flush liquid pipe.

3. A flushing device according to claim 1, wherein the flush liquid pipe (6) is arranged substantially vertically in the enclosed space (2), whereby the flush head (7) is rotatable about the substantially vertical longitudinal axis (A) of the flush liquid pipe (6), and the nozzle device (8) is rotatable about the axis (B) of said nozzle device (8) which extends substantially transversely to the vertical longitudinal axis of the liquid flush pipe.

4. A flushing device according to claim 3, wherein the flush liquid pipe is arranged in the enclosed space (2) such that it hangs substantially vertically downwards from the upper surface of said space.

5. A flushing device according to claim 1, wherein the flush head (7) and the nozzle device (8) are designed to be rotated by the flush liquid and/or a transmission and/or by an external drive.

6. A flushing device according to claim 1, wherein said at least one nozzle (9, 11) of the nozzle device (8) is arranged such that the angle thereof in relation to the flush liquid pipe (6) is adjustable.

7. A flushing device according to claim 1, wherein said at least one nozzle (9, 11) of the nozzle device (8) is formed such that the spread of the flush liquid stream (10, 12) from the nozzle is adjustable.

8. A flushing device according to claim 1, wherein said at least one nozzle (11) of the nozzle device (8) is arranged angled towards the flush liquid pipe (6) and/or formed for spreading of the flush liquid stream (12) from the nozzle so as to generate a flush liquid stream (12) which—during the rotation of the nozzle device—substantially forms or delimits a cone which opens in the direction of the flush liquid pipe (6) or the flush liquid pipe and an imaginary extension thereof, along a portion of the periphery of the flush liquid pipe, and which—during rotation of the flush head (7)—opens in the direction of the flush liquid pipe or the flush liquid pipe and an imaginary extension thereof, along the entirety or a portion of the periphery of the flush liquid pipe.

9. A flushing device according to claim 8, wherein the nozzle (11) is aligned with the flush liquid pipe (6), at an angle ($\alpha$) of 1°-30° relative to the longitudinal axis of the flush liquid pipe.

10. A flushing device according to claim 9, wherein the angle ($\alpha$) at which the nozzle (11) is aligned with the flush liquid pipe (6) is adjustable with said interval of 1°-30° relative to the longitudinal axis.

11. A flushing device according to claim 1, wherein said nozzles (9, 11) are arranged peripherally on the nozzle device (8) in the form of a hub.

12. A flushing device according to claim 8, wherein the hub (8) comprises four nozzles (9, 11) arranged peripherally thereon, of which two are arranged angled towards the flush liquid pipe (6) and/or formed for spreading of the flush liquid stream (12) from the nozzles (11) such that at least a portion of the flush liquid streams (12) from the nozzles (11) during at least a part of the rotation of the hub (8) contacts the flush liquid pipe (6) along a portion of the periphery of said flush liquid pipe, and such that at least said portion of the flush liquid streams from the nozzles contact the flush liquid pipe during the rotation of the flush head (7), along the entire periphery, for cleaning said flush liquid pipe.

13. A flushing device according to claim 9, wherein said two nozzles (11) are arranged diametrically opposite each other on the hub (8).

14. A flushing device according to claim 1, wherein—besides said nozzles (9, 11)—the nozzle device (8) also comprises at least one nozzle which is arranged and/or formed so as to generate a flush liquid stream which—during the rotation of the nozzle device—forms or delimits a cone which opens in the direction away from the flush liquid pipe (6).

15. A flushing device for cleaning the inside of an enclosed space with a flush liquid, the flushing device comprising:

a flush liquid pipe arranged in the enclosed space;

at least one flush head substantially rotatable about a longitudinal axis of the flush liquid pipe; and a nozzle device arranged on the flush head, the nozzle device being substantially rotatable about an axis extending transverse to the longitudinal axis of the flush liquid pipe, the nozzle device having one or more nozzles to provide one or more flush liquid streams directed substantially against the inside of the enclosed space, at least one of the nozzles being angled towards the flush liquid pipe to spread the flush liquid stream such that at least a portion of the flush liquid stream contacts at least a portion of the periphery of the flush liquid pipe during rotation of the nozzle device about the axis and during rotation of the flush head about the longitudinal axis, thereby cleaning the flush liquid pipe.

* * * * *